US011623835B2

(12) United States Patent
Huybreckx

(10) Patent No.: US 11,623,835 B2
(45) Date of Patent: Apr. 11, 2023

(54) EXPANDER ROLLER FOR FOLD-FREE EXPANSION OF FOILS

(71) Applicant: KOTI Onroerend Goed b.v., Weert (NL)

(72) Inventor: Michel Jozef Rene Lambert Huybreckx, Weert (NL)

(73) Assignee: KOTI ONROEREND GOED B.V., Dg Weert (NL)

( * ) Notice: Subject to any disclaimer, the term of this patent is extended or adjusted under 35 U.S.C. 154(b) by 298 days.

(21) Appl. No.: 16/839,805

(22) Filed: Apr. 3, 2020

(65) Prior Publication Data

US 2020/0369485 A1 Nov. 26, 2020

(51) Int. Cl.
*B65H 23/025* (2006.01)
*D06C 3/06* (2006.01)

(52) U.S. Cl.
CPC ..... *B65H 23/0251* (2013.01); *D06C 3/06* (2013.01); *B65H 2404/1151* (2013.01)

(58) Field of Classification Search
CPC ..... B65H 23/0251; B65H 2404/1151; D06C 3/06
See application file for complete search history.

(56) References Cited

FOREIGN PATENT DOCUMENTS

| | | | | |
|---|---|---|---|---|
| DE | 202004007333 | U1 | 12/2004 | |
| DE | 102005021467 | A1 | 11/2006 | |
| DE | 102010055168 | A1 | 6/2012 | |
| DE | 202013001888 | U1 | 4/2013 | |
| DE | 102014011522 | A1 | 2/2016 | |
| DE | 102015008081 | A1 * | 12/2016 | |
| EP | 1705143 | A1 * | 9/2006 | ..... B65H 23/0251 |

* cited by examiner

*Primary Examiner* — William E Dondero

(74) *Attorney, Agent, or Firm* — R. Neil Sudol; Henry D. Coleman

(57) ABSTRACT

An expander roller for a fold-free expansion of foils, webs, and sheet materials in a width dimension. The expander roller has a central metal axle mounted in a surrounding synthetic tube with placed on its circumference a grid of implanted brush plugs in an axial direction under an angle alpha and with a mutual distancing and in tangential direction under a center angle beta and with a mutual distance. The roller provides a perfect expanding or stretching of thin widths of different materials.

10 Claims, 2 Drawing Sheets

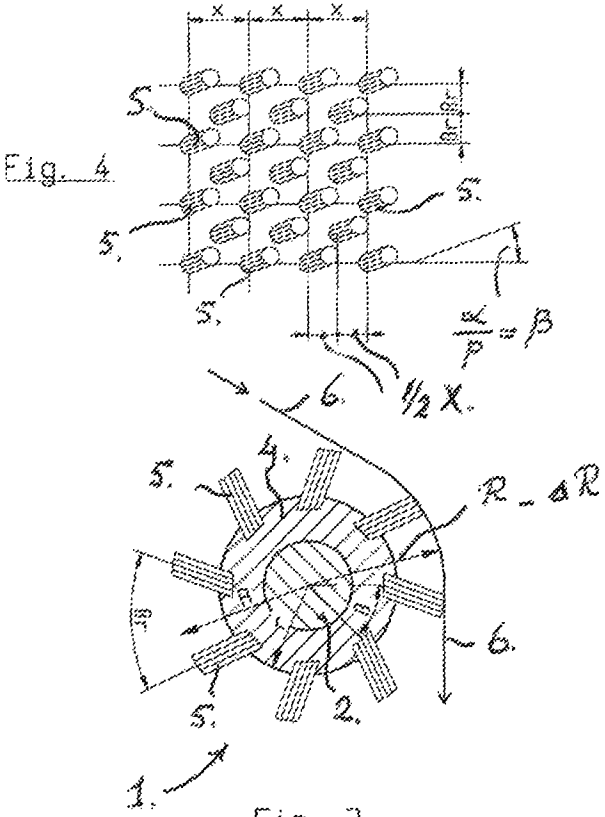
Fig. 3
Fig. 4
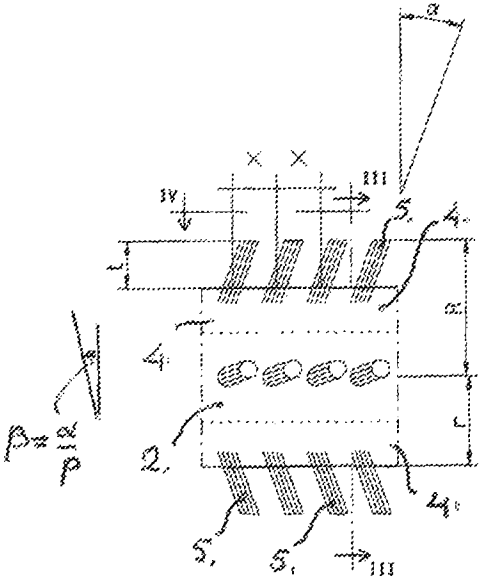
Fig. 2

EXPANDER ROLLER FOR FOLD-FREE EXPANSION OF FOILS

FIELD OF THE INVENTION

The present invention concerns an expander roller for fold-free expansion of foils, widths of paper or textile e.g. This expander roller with length L obliquely implanted with elastic brush plugs at his outer circumference in order to spread said foils or widths of different materials.

BACKGROUND OF THE INVENTION

Such an expander roller is known by the German Patent DE102004 038 165.8, filed Jun. 8, 2004, entitled: "Process for the Spreading of Moving Bands", inventor Rolf Hessenbruch, Remscheid, Germany. This patent describes a method and device formed as a roller in order to spread thin widths of material, which are forced to move over the circumference of the roller, which is covered with brush plugs. The spreading or expanding roller device has obliquely implanted elastic brush plugs disposed in rows. These rows of brush plugs are obliquely implanted from the middle of the roller's axle to the left and to the right of the support structure. In a modified expander roller the brush parts are imbedded in an elliptic way around the circumference of the roller (FIG. 8) in order to create a bigger distance between the rows of brush plugs. This creates a spread in motion and cross direction of the thin width or foils. The surface of the brush plug has somewhat the shape of a wave and is firstly obliquely cut in the axial direction of the roller.

A drawback is, that the very intensive placing or mounting of the brush plugs in intensive rows on the circumference react to an incomplete and not uniform spreading or expanding force on the foils or widths, which widths forced under pressure around a segmental part of the expander roller. Furthermore, due to the intensive placing of the brush plugs in general, with little intermediate distance, the production costs will increase, which is not a very economical solution. This also applies to the elliptical placing of the brush plug around the circumference of the expander roller. It is rather complicated and it does not have the desired effect.

OBJECT OF THE INVENTION

Therefore the aim of our invention is to overcome mentioned drawbacks and to provide an expander roller that operates more efficiently and is less costly to manufacture.

SUMMARY OF THE INVENTION

The expander roller according to the invention for the fold-free expansion exemplarily of foils is characterized in that the expander roller is a type of built-up roller tube with a total circumference radius R, a usable length of 2 ×L/2 and with its ends placed in a support structure for free rotation, wherein a circumferential surface consists of a grid of obliquely implanted brush plugs with a free length t, wherein the brush plugs each form (a) an angle alpha ($\alpha$) with with respect to a radial plane oriented transversely to the outer circumferential surface and a longitudinal axis of the roller tube and (b) an angle partly beta ($\beta=\alpha/p$) with a normal axial plane and in the tangential direction, wherein the mutual centre-to-centre distance of the brush plugs in the rows is a predetermined distance X in the axial direction, wherein the mutual separation distance of the brush plugs in the tangential direction is determined by the centre angle beta ($\beta$) and the radius r of the expander roller and wherein each following axial row of brush plugs on the circumference is shifted ½X to each other in the axial direction.

The advantage is a very economical executed expander roller, that in practice operates to expand thin material widths with better results.

Furthermore according to the invention the dimensions of the expander roller are as follows. R is between 50 mm and 500 mm, preferably 200 mm, r is between 25 mm and 400 mm, preferably 150 mm, and L is between 1000 mm and 5000 mm, preferably 2500 mm, in which the angle alpha ($\alpha$) is between 7 degrees and 25 degrees, preferably 12 degrees, and the angle partly beta ($\beta=\alpha/p$) is between 0.2 alpha and 0.5 alpha, preferably 0.25 alpha.

The advantage is that for each application an optimal solution can be produced in an economical way by varying X and the angle $\beta$.

Next, in an expander roller according to the invention the length t of the obliquely implanted brush plugs is between 5 mm and 25 mm, preferably 12 mm, and the material of the obliquely bended brush roller is a synthetic material such as polypropylene, wherein the diameter of plug threads, fibers or bristles of the brush plugs is between 0.1 mm and 0.8 mm, preferably 0.25 mm.

The advantage is brush plugs which can be adapted for optimal application in the spreading of all kinds of material widths.

BRIEF DESCRIPTION OF THE DRAWING

A preferred embodiment of the present invention will now be described with reference to the accompanying drawing, in which:

FIG. 2 shows a partial side view with only three rows represented with brush plugs according to the invention;

FIG. 3 shows a cross-section taken along line III-III in FIG. 2; and

FIG. 4 shows a top view taken along line IV in FIG. 2 to show the grid of the brush plugs.

DETAILED DESCRIPTION

Figure 1:
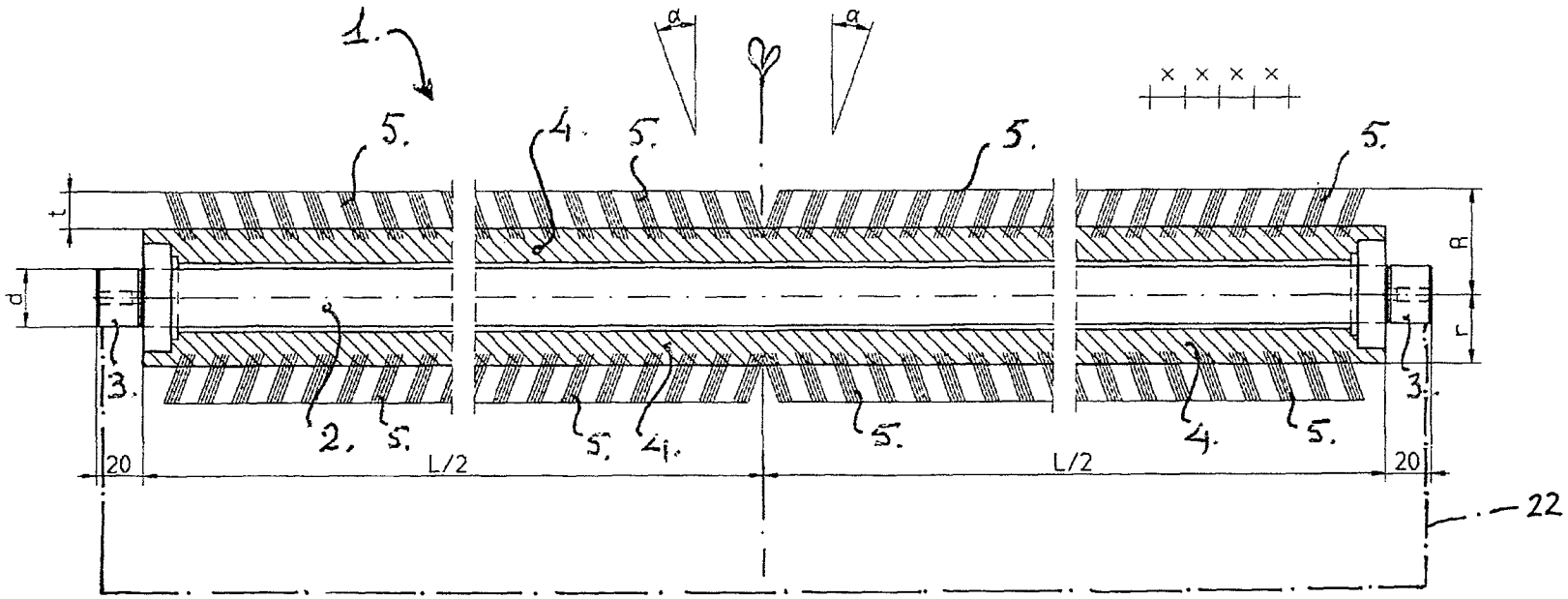
FIG. 1 shows an axial section of the expander roller according to the invention.

FIG. 1 represents an axial section of the expander roller 1 according to the invention. The expander roller 1 has a central axle 2, with ends 3 placed in a support structure (20) for free rotation. A tube structure 4 of a mostly synthetic material, such as polypropylene, is mounted around the central axle 2. Tube structure 4 can be made as a tube or in cylindrical parts. Brush parts or plugs 5 are implanted in bore holes in the circumference of tube structure 4 with special machines. As can been seen in FIG. 2, along a left half length L/2 of the axle 2 the brush parts 5 are placed under an angle alpha ($\alpha$) inclined towards the left and along a right half length L/2 of the axle 2 the brush parts 5 are inclined by angle alpha ($\alpha$) to the right for implementing the expanding or stretching procedure. The angle alpha ($\alpha$) is between 7 degrees and 25 degrees, preferably 12 degrees. The distance X is between 5 mm and 15 mm, preferably 10 mm. The distance $\beta r$ is due to the radius r and angle beta ($\beta$). For different applications of expanding or spreading foils, widths of different materials, the measurements X and $\beta r$ can be adapted to an optimum for special use. In addition, the bending strength of the brush parts or plugs 5 may vary from the center towards the end of the expander roller 1 and more particularly may increase from the center towards the end for special applications.

FIG. 2 represents a partial side view with only three rows with brush plugs 5. For identical parts identical numbers are used.

FIG. 3 represents a cross-section taken along the line III-III in FIG. 2. In the cross-section the foil 6 or other thin material to expand or stretch is forced around a segmental part of the expander roller 1. Some of the brush plugs 5 are deformed for the expanding or stretching operation. The total radius R is diminished to R-AR. The free length t of the brush plugs 5 is between 5 mm and 25 mm, preferably 12 mm. The brush plugs 5 have threads, fibers or bristles with a diameter between 0.1 mm and 0.8 mm, preferably 0.25 mm.

FIG. 4 represents a top view over the line IV of FIG. 2 to show the grid op the brush plugs. Identical parts are indicated with identical numbers. Finally is has to be emphasized, that a preferred embodiment of the invention is described an that it is self-evident that further modifications are possible without leaving the scope of this invention.

The invention claimed is:

1. An expander roller for fold-free expansion of foils comprises:

a roller tube with a length L, a radius r, and an axle having ends placed in a support structure for free rotation;

a plurality of brush plugs implanted in a grid array in a circumferential surface of the roller tube and having a common free length t, wherein:

the brush plugs each form an angle alpha ($\alpha$) with respect to a radial plane oriented transversely to the outer circumferential surface and a longitudinal axis of the roller tube;

the brush plugs are each inclined in the tangential direction and form an angle partly beta ($\beta=\alpha/p$) with a normal axial plane, where angle beta ($\beta$) is a centre angle;

the brush plugs in each of a plurality of axially extending rows have a mutual centre-to-centre distance X;

the brush plugs have a mutual separation distance in the tangential direction determined by the centre angle beta ($\beta$) and the radius r of the expander roller; and the brush plugs of every other axially extending row are axially shifted by a distance ½X relative to the brush plugs in the other axially extending rows.

2. Expander roller as in claim 1, wherein said roller tube is made of a synthetic material and surround said axle.

3. Expander roller as in claim 1, wherein the expander roller including the brush plugs has an outer radius R between 50 mm and 500 mm, wherein radius r is between 25 mm and 400 mm and length L is between 1000 and 5000 mm.

4. Expander roller as in claim 1, wherein said angle alpha ($\alpha$) is between 7 degrees and 25 degrees and said partly angle beta $\beta(\beta=\alpha/p)$ is between 0.2 alpha and 0.5 alpha.

5. Expander roller as in claim 1, wherein said distance X is between 5 mm and 15 mm.

6. Expander roller as in claim 1, wherein said length t of the obliquely implanted brush plugs is between 5 mm and 25 mm.

7. Expander roller as in claim 6, wherein the material of the obliquely bended brush roller is polypropylene, and wherein the brush plugs have threads, fibers, or bristles with a diameter is between 0.1 mm and 0.8 mm.

8. Expander roller as in claim 1, wherein the bending strength of the brush plugs from the center of the expander roller up towards the end varies.

9. Expander roller as in claim 1, wherein said brush plugs are obliquely cut off in the axial direction of the expander roller.

10. Expander roller as in claim 1 wherein the brush plugs along along each half end portion of the circumferential surface roller are inclined from the centre towards the respective roller end at the angle $\alpha$.

* * * * *